US006035864A

United States Patent [19]

Kennedy

[11] Patent Number: 6,035,864

[45] Date of Patent: Mar. 14, 2000

[54] METHOD AND APPARATUS FOR ORNAMENTING HAIR

[75] Inventor: Kathy Kennedy, Rancho Santa Margarita, Calif.

[73] Assignee: Beadwear, Inc., Rancho Santa Margarita, Calif.

[21] Appl. No.: 09/314,875

[22] Filed: May 19, 1999

[51] Int. Cl.[7] ..... A45D 8/04; A45D 8/12; A45D 24/00; A45D 7/02

[52] U.S. Cl. ..... 132/273; 132/200; 132/212; 132/275

[58] Field of Search ..... 132/273, 275, 132/276, 278, 277, 279, 280, 281, 282, 283, 284, 144, 200, 212; 219/143, 129; 223/50, 105, 99; 119/801, 808; 29/433, 241; 66/117, 118

[56] References Cited

U.S. PATENT DOCUMENTS

| | | | |
|---|---|---|---|
| 1,144,504 | 6/1915 | Schneider . | |
| 2,567,408 | 9/1951 | Soderberg . | |
| 2,943,371 | 7/1960 | Patterson | 132/273 |
| 3,045,684 | 6/1962 | Stolz . | |
| 3,842,849 | 10/1974 | Goodman | 132/273 |
| 4,102,478 | 7/1978 | Samoilov | 223/99 |
| 4,315,362 | 2/1982 | Pigford et al. | 29/433 |
| 4,338,714 | 7/1982 | Powderly | 29/433 |
| 4,388,753 | 6/1983 | Brookes | 29/433 |
| 4,551,899 | 11/1985 | Castillo | 29/241 |
| 4,667,860 | 5/1987 | Feuerman | 223/99 |
| 4,779,616 | 10/1988 | Johnson | 128/334 |
| 5,097,854 | 3/1992 | Smith | 132/273 |
| 5,167,245 | 12/1992 | Harriett | 132/273 |
| 5,289,834 | 3/1994 | Lawrence | 132/212 |
| 5,417,230 | 5/1995 | Wood | 132/212 |
| 5,456,271 | 10/1995 | Legette | 132/212 |
| 5,558,105 | 9/1996 | Rosenwinkel et al. | 132/212 |
| 5,566,690 | 10/1996 | Shih-Ming | 132/276 |
| 5,664,707 | 9/1997 | Spector | 223/48 |
| 5,669,398 | 9/1997 | Dadgostar | 132/210 |
| 5,687,751 | 11/1997 | Villani | 132/212 |
| 5,713,218 | 2/1998 | McCabe | 132/275 |
| 5,810,022 | 9/1998 | Reynolds | 132/200 |
| 5,832,938 | 11/1998 | Ybarra | 132/210 |
| 5,833,335 | 11/1998 | Voughlohn | 132/273 |
| 5,881,738 | 3/1999 | Villani | 132/200 |

*Primary Examiner*—John J. Wilson
*Assistant Examiner*—Robyn K Doan
*Attorney, Agent, or Firm*—Weide & Associates

[57] ABSTRACT

A method and apparatus for ornamenting ornament stringing material such as hair is disclosed. In accordance with one embodiment, the apparatus comprises a tool having first and second legs. The legs are connected at a proximal end of the tool. A stop is associated with each leg at a distal end of the tool. In accordance with a method, an ornament is passed over the proximal end of the tool and along the legs towards the stops. Ornament stringing material is extended between the first and second legs between their connection at the proximal end of the tool and the ornament. The ornament is then moved upwardly along the legs of the tool and onto the ornament stringing material. The ornament stringing material is then removed from between the legs of the tool, leaving the ornament positioned on the ornament stringing material.

14 Claims, 2 Drawing Sheets

METHOD AND APPARATUS FOR ORNAMENTING HAIR

FIELD OF THE INVENTION

The present invention relates to a method and apparatus for placing ornaments, such as beads or rings, onto an ornament stringing material, such as hair.

BACKGROUND OF THE INVENTION

It is a common and popular practice to use beads or other items to ornament real or artificial hair.

Placing beads on hair can be difficult and time consuming. The beads are often placed one by one onto the hair by threading hair therethrough. Alternatively, locks of hair may be wrapped in foil, the beads strung over the foil-wrapped hair, and then the foil removed. Another method for placing beads on hair is by threading beads over a needle with a loop of string attached, passing the beads over the loop of string, passing the hair through the loop formed by the string, and then backing the beads along the string onto the hair.

These methods of ornamenting hair are difficult and time consuming. The "needle and string" method is difficult because the beads easily fall off of the string. In addition, the needle is hazardous and not suitable for small children. Also, these methods are adapted for placing small beads on hair, and do not lend well to placing other ornaments on hair.

A need exists for an improved method and apparatus for placing ornaments such as beads onto hair.

SUMMARY OF THE INVENTION

The invention is a method and apparatus for ornamenting ornament stringing material, such as hair.

One embodiment of the invention comprises an apparatus for placing or positioning one or more ornaments on ornament stringing material. In one embodiment, the apparatus comprises a tool having a first and second legs. The legs are connected at a proximal end of the tool. A stop is associated with each leg at a distal end of the tool.

In a preferred embodiment, a tip is located at the proximal end of the tool. In one or more embodiments, each stop comprises a foot which extends outwardly from and towards the proximal end of the tool. Each foot cooperates with its respective leg to form a trough.

One embodiment of the invention is method for placing or positioning one or more ornaments on ornament stringing material. In a preferred embodiment, the method comprises passing an ornament over the proximal end of the tool and along the legs towards the stops, extending ornament stringing material between the first and second legs between their connection at the proximal end of the tool and the ornament, moving the ornament upwardly along the legs of the tool onto the ornament stringing material, and removing the ornament stringing material from between the legs of the tool, leaving the ornament positioned on the ornament stringing material.

In one or more embodiments, the method includes the steps of compressing the legs towards one another when the ornament is passed thereover, and then expanding the legs apart before extending the ornament stringing material therebetween.

Further objects, features and advantages of the invention will become apparent from the detailed description of the drawings which follows, when considered with the attached figures.

DETAILED DESCRIPTION OF THE INVENTION

The invention is a method and apparatus for ornamenting hair or other ornament stringing material. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Apparatus For Placing One Or More Ornaments On Ornament Stringing Material

One or more embodiments of the invention comprise an apparatus for placing or locating one or more ornaments on a stringing material. The ornament stringing material may comprise a wide variety of materials. For example, if the ornament is to be placed on the simulated "hair" of a doll, the stringing material may comprise string, yarn, synthetic hair or the like. In a preferred embodiment, the stringing material comprises hair, such as the hair of a human.

Figure 1:
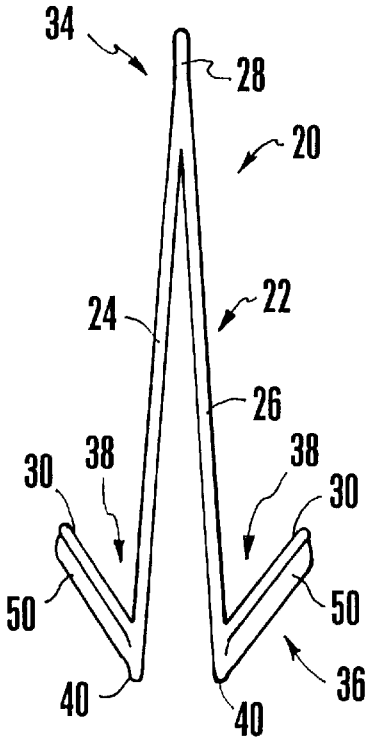
FIG. 1 is a perspective view of a tool in accordance with the present invention useful in placing one or more ornaments onto ornament stringing material such as hair.

FIG. 1 illustrates an apparatus in accordance with one embodiment of the invention for use in placing one or more ornaments on stringing material. As illustrated therein, the apparatus comprises a tool 20.

The tool 20 comprises a generally inverted "V"-shaped body 22. The tool 20, including the body 22, has a proximal end 34 and a distal end 36.

The body 22 has a first link or leg 24 and a second link or leg 26. The first and second legs 24,26 each have a first or proximal end. The first ends of the legs 24,26 are connected or joined at the proximal end 34 of the body 22. The first and second legs 24,26 also each have a second or distal end.

The tool 20 preferably includes a stop element. In a preferred embodiment, a stop is associated with each leg 24,26. As described in more detail below, a stop is formed at the distal end of each leg 24,26 by a foot 30 cooperating with each leg 24,26.

While the legs 24,26 are described and illustrated as connected at their very ends, they may be connected at some point therealong. In this regard, the terms "proximal" and "first" are not intended to be limited to mean the very tip of the legs 24,26, but may be interpreted generally comprise a portion of each leg generally opposite its second end. Likewise, the terms "distal" and "second" are not intended to be limited to mean the very tip of the legs 24,26, but may be interpreted generally to include a portion of each leg generally opposite its first end.

The proximal end 34 of the tool 20 is configured so that it will fit through or within one or more of a variety of ornaments. In one or more embodiments, the first ends of the legs 24,26 form an inverted "V" which will pass through or within the opening, passage or other stringing material accepting area of an ornament (such as a passage through a ring 32, as described in more detail below).

Preferably, a tip 28 is defined at the proximal end 34 of the body 22. The tip 28 extends from the connection of the first ends of the legs 24,26 in a direction opposite the distal end 36 of the body 22. The tip 28 preferably has the shape of a needle-tip, shaft or pointed threader.

Figure 2:
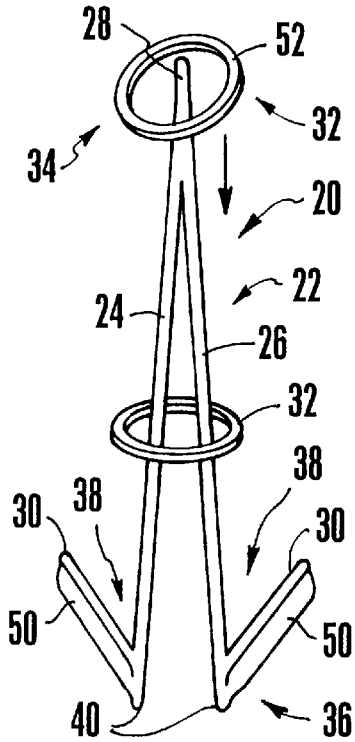
FIG. 2 illustrates the tool illustrated in FIG. 1 with one ornament placed thereon and another being placed thereon.
Figure 3:
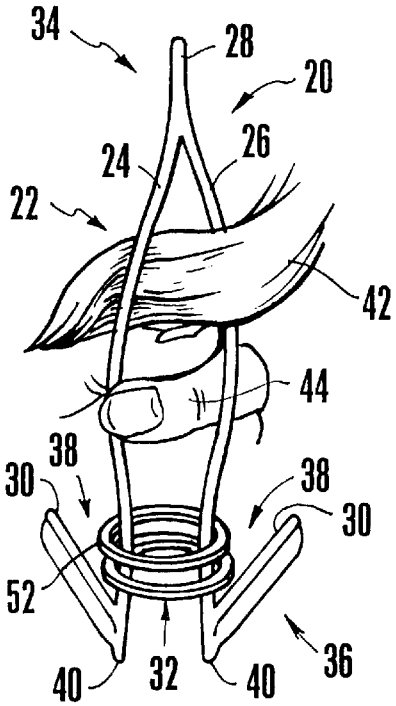
FIG. 3 illustrates the tool illustrated in FIG. 2 with ornament stringing material extended through a portion of the tool.

The legs 24,26 are arranged to move with respect to one another between positions in which they are closer and farther apart, as illustrated in FIGS. 1 and 2. In one or more embodiments, at least a portion of the body 22 of the tool 20 comprises a somewhat flexible material. Preferably, the legs 24,26 or a portion thereof comprise a flexible material, allowing them to bend and flex as illustrated in FIG. 3.

In one or more embodiments, the tip 28 or the connection of the first ends of the legs 24,26 may comprise a hinge or similar element which facilitates relative movement of the legs 24,26. Alternatively, the first and second legs 24,26 may be arranged to be selectively connectable and disconnectable at their first ends so that they may be moved with respect to one another.

In one or more embodiments, means are provided for biasing the legs 24,26 apart from one another, whereby the tool naturally assumes a position such as that illustrated in FIG. 1. In this position, the legs 24,26 are spaced apart at other than their second ends by some distance when the tool 20 is in an unbiased state.

This biasing means may comprise the natural resiliency of the material of which the tool 20 is constructed, a spring-loaded hinge when a hinge forms the interconnection of the first ends of the first and second legs 24,26, or other means well known to those of skill in the art. In the embodiment illustrated, the connection of the first and second legs 24,26 at their first ends serves to maintain the legs 24,26 in an open or spread apart position in their unbiased state. This may be accomplished by adjusting the angle at which the first and second legs 24,26 are connected and/or the structure of the connection, such as the material from which it is constructed. For example, while the legs 24,26 may be relatively flexible, their interconnected first ends may comprise a rigid plastic material, the connection of the legs 24,26 with this material forcing the legs to assume a spread-apart position when in an unbiased state.

The distal end 36 of the tool 20 is configured to prevent an ornament which has been placed on the tool 20 (as described in more detail below) from becoming disassociated from the tool 20. In this regard, in one or more embodiments, at least one stop is provided at the distal end 36 of the tool 20. Preferably, two stops are provided, one associated with each leg 24,26.

Preferably, each stop comprises a trough 38 formed between a foot 30 and its respective leg 24,26. As illustrated, one foot 30 extends outward from the second end of the first leg 24 and another foot extends outward from the second end of the second leg 26. Preferably, each foot 30 diverges or extends away from its adjacent leg 24,26 moving in the direction of the distal to the proximal end 36,34 of the body 22 of the tool 20.

As illustrated, each foot 30 cooperates with its adjacent leg 24,26 to form a trough 38 which is generally "V"-shaped. Preferably, similar to the tip 28 at the proximal end of the tool 20, a tip 40 is provided at the interconnection of each foot 30 and its mating leg 24,26. These distal tips 40 are positioned opposite the troughs 38 and extend in a direction generally opposite the proximal end 34 of the body 22 of the tool 20. These tips 40 (similar to tip 28) aid in maintaining each foot 30 apart from its adjacent leg 24,26, keeping the troughs 38 in an open position.

While it is preferred that each foot 30 extend from the second or distal end of each leg 24,26, either or both feet may extend from the leg(s) 24,26 at another location, such as a point between the proximal and distal ends of the tool 20. The stop associated with the tool 20 may comprises a wide variety of other elements and/or take on a variety of other forms providing the effect of substantially preventing one or more ornaments from being removed or falling from the distal end of the tool 20 when the ornament(s) are placed thereon. For example, only one stop may be provided. The stop also need not comprise a trough. For example, the stop may comprise a large disk or bulb element attached to the distal end of one or both legs 24,26.

In one or more embodiments of the invention, the body 22 of the tool 20 comprises a single, unitary member. The tool 20 may also comprise more than one element. For example, the two legs 24,26 may comprise separate elements which are then connected or connectable to form the body 22. Similarly, each foot 30 may be formed separately and connected to a respective leg 24,26.

When the tool 20 comprises a unitary element, it may be formed by molding. In one or more embodiments, the tool 20 comprises polyethylene. Polyethylene is easily molded, and permits the tool 20 to be both flexible and durable. Of course, the tool 20 may be constructed of a wide variety of materials and in a wide variety of manners. For example, the tool 20 may be comprise stamped or molded metal, other plastics or the like. In addition, the proximal tip 28 may comprise a separate element which is connected to or positioned at the proximal end of one or both of legs 24,26.

In the embodiment illustrated, the portions of the body 22 of the tool 20, including the legs 24,26, feet 30 and tips 28,40, generally have a circular cross-section. Thus, the legs 24,26 and feet 30 generally take the forms of rods or shafts.

The tool 20 may have a variety of dimensions. In one or more embodiments, the tool 20 is about 6.5 inches long, each foot 30 is about 1.5 inches long, and each foot 30 and the legs 24,26 have a cross-sectional diameter of about 0.065 inches. Preferably, the tip 28 at the proximal end 34 of the tool 20 is sized to allow the passage of a wide variety of ornaments thereover. For example, the tip 28 may have an exterior diameter of around 0.0625 inches. Of course, the tool 28, including the tip 28, may have a wide variety of dimensions dependent upon the requirements of the user, including the size(s) of the ornaments which are to be placed with the tool 20.

As illustrated in FIG. 1, a thin flashing 50 may be formed on the body 22 of the tool 20, such as on a bottom portion of each foot 30. Product or other information may be molded into this flashing 50, or the information may be printed onto the flashing 50, printed on a label placed onto the flashing or the like. This flashing 50 is, however, not necessary for the operation of the tool 20 in placing ornaments 32 as described below.

Method of Placing One of More Ornaments Upon Ornamenting Stringing Material

One or more embodiments of the invention comprise a method for placing one or more ornaments on ornament stringing material using the tool 20 of the invention. This method will be described with reference to FIGS. 2–6.

First, as illustrated in FIG. 2, one or more ornaments 32 are placed on the tool 20. In the embodiment illustrated, there are two ornaments 32, each ornament comprising a ring 52. It is noted that the apparatus and method of the invention are not limited to the placement of two ornaments as described and illustrated specifically in FIGS. 2–6, but may be used to place a single ornament and more than two ornaments.

In general, the ornaments 32 which are useful in being placed with the tool 20 of the invention are those which define a passage, bore or other area through which ornament stringing material may pass, such as beads, rings, loops of material and the like.

In the embodiment illustrated, the rings 52 each have a central passage. The rings, like any other type of ornament 32 may be constructed from metal, plastic, ceramic, cloth and any of a wide variety of other materials, as well known to those of skill in the art.

In a first step, the ornaments 32 are placed on the tool 20. In a preferred embodiment, the ornaments 32 are threaded onto the tool 20 starting at the proximal end 34, such as by extending the tip 28 through the open interior of the ornament 32, as in the case where the ornaments comprise rings. The ornaments 32 are moved distally along the body 22 of the tool 20 over the legs 24,26. Depending on the size of the ornaments 32 which are placed on the tool 20, movement of the ornaments 32 to the distal end 36 of the tool 20 may require that the legs 24,26 be compressed inwardly towards one another.

The ornaments 32 are moved along the body 22 of the tool 20 towards its distal end 36. The ornaments 32 may be moved until they reach the troughs 38. Advantageously, the ornaments 32 are prevented from moving further in the distal direction, and thus prevented from being removed from or falling off of the distal end 36 of the tool 20, by the stops defined by each foot 30 extending from its corresponding leg 24,26.

Once all the desired ornaments 32 are located on the tool 20, as illustrated in FIG. 3, ornament stringing material 42 is threaded or directed between the legs 24,26 at a location along the tool 20 between the proximal end 34 and the ornaments 32. In order to fit the ornament stringing material 42 between the legs 24,26, it may be necessary to separate the legs 24,26 by some distance, such as by pressing one or more fingers 44 in between the legs 24,26. In at least one embodiment, this is accommodated by the flexible nature of the legs 24,26. In one or more other embodiments, this may be permitted by separating the legs 24,26 from one another at or near their first ends.

In the preferred embodiment of the invention, this step comprises passing a free end of the ornament stringing material 42, such as the free end of a lock of hair, between the legs 24,26.

Figure 4:
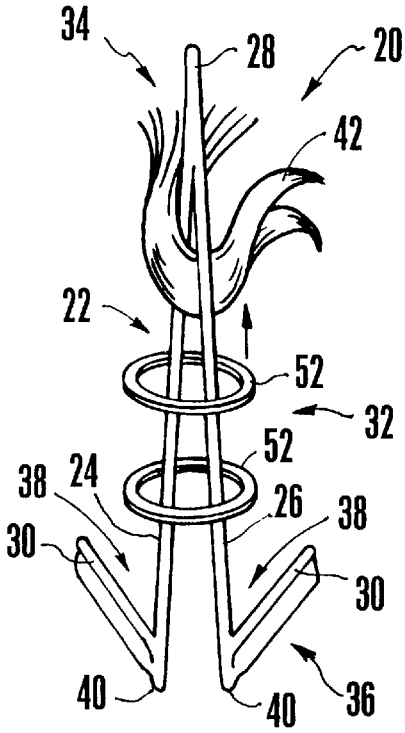
FIG. 4 illustrates the tool illustrated in FIG. 3 with the ornaments on the tool moved upwardly therealong.
Figure 5:
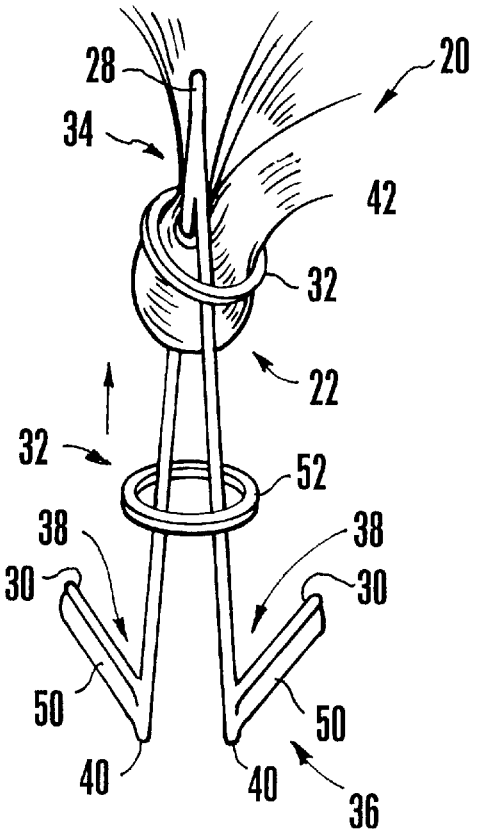
FIG. 5 illustrates the tool illustrated in FIG. 4 with the ornaments being positioned onto the ornament stringing material.

Referring to FIG. 4, in a next step the ornaments 32 are moved upwardly towards the proximal end 34 of the tool 20. As illustrated in FIG. 5, this ultimately results in the ornaments 32 being removed from the tool 20 at its proximal end 34 and being placed on the ornament stringing material 42. In this step, the free end of the ornament stringing material 42 may loop back upon itself. This is especially true if the size of the passage through the ornament 32 is small in relation to the thickness of the ornament stringing material 42. In the embodiment illustrated in FIG. 5, the ornament stringing material 42 is illustrated as looping back upon itself. Once the ornaments 32 are moved further upwardly along the stringing material 42, the ornaments 32 move past the free end of the material.

Figure 6:
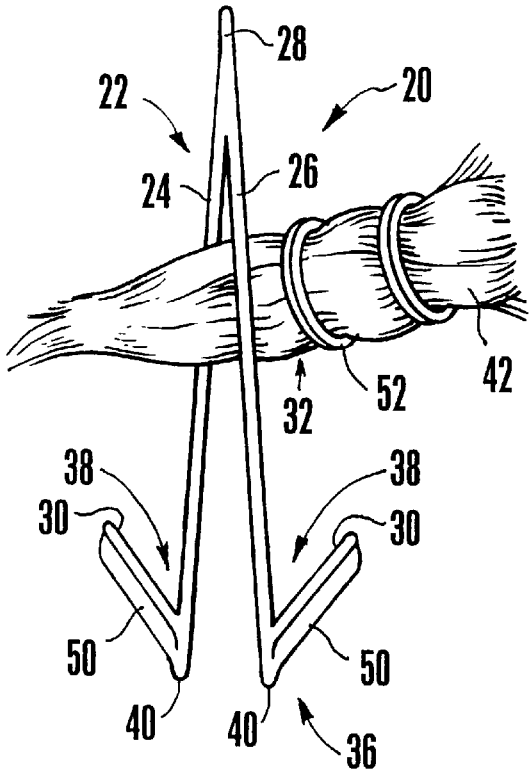
FIG. 6 illustrates the tool illustrated in FIG. 5 with the ornaments removed from the tool and placed on the ornament stringing material.

As illustrated in FIG. 6, once the ornaments 32 are placed on the ornament stringing material 42, the ornament stringing material 42 and tool 20 may be separated. If the ornament stringing material 42 looped back on itself when the ornaments 32 were placed thereon, then the free end of the material 42 may be pulled back through the ornaments 32.

Means may then be utilized, if necessary, to retain the ornaments 32 on the ornament stringing material 42. For example, the ornaments 32 may be locked onto the ornament stringing material 42 and prevented from falling off of the free end thereof by placing a clip along the ornament stringing material 42 between its free end and the ornaments 32.

Once the ornaments 32 are removed from the tool 20, the tool 20 returns to its original, unbiased position (as illustrated in FIG. 1) in the event where a change in shape of the tool 20 was required to place the ornaments 32 thereon (such as when the legs 24,26 are compressed towards one another, as illustrated in FIG. 2).

In the above-described method, the movement of the various items, such as the ornaments 32 along the tool 20 is relative. Thus, the ornaments 32 may be moved along or with respect to the tool 20 (i.e. the position of the tool is fixed and the position of the ornaments changes) or the tool 20 moved with respect to the ornaments 32 (i.e. the position of the ornaments is fixed and the position of the tool changes) or the tool and ornaments may both be moved in order to position the ornaments 32, tool 20 and/or bead stringing material as described above.

The tool 20 and method described above have many advantages. First, the tool 20 is useful in placing a wide variety of differing sized ornaments 32 on ornament stringing material. For example, a small hair bead may be threaded onto the tool 20. In that case, the tip 28 facilitates the placement of the bead onto the tool 20, since the tip 28 is easily inserted into the rather small passage through the bead. In addition, the flexibility of the legs 24,26 both permits the bead to be moved to the distal end 36 of the tool 20, but still permits the legs 24,26 to be separated between the bead and the connection of the legs at the proximal end 34 to permit passage of the ornament threading material therebetween. On the other hand, larger items such as rings may be placed on the tool 20 and are retained on the tool 20 during the placement process as a result of the stops.

The tool 20 is simple in construction and use. The method in accordance with the invention permits a user to quickly and easily place one or more ornaments, such as beads, on the tool 20 and onto hair or other stringing material. The tool 20 and method thus avoid the problems associated with the prior art.

The preferred unitary and moldable construction of the tool 20 makes it simple and cost-effective to manufacture. Each foot 30 cooperates with a leg 24,26 to form an effective stop in a simple manner, and without adding excessive weight or material to the tool 20.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An apparatus for placing at least one ornament on ornament stringing material, said apparatus comprising a body having a proximal end and a distal end, a first leg having a first end and a second end, a second leg having a first end and a second end, said first end of said first leg and said first end of said second leg joined at said proximal end of said body, said first and second legs at said distal end spaced apart from one another in a resting state, a first foot and a second foot, said first foot extending from said second end of said first leg and said second foot extending from said second end of said second leg, said first and second legs, said first foot and said second foot extending towards said proximal end of said body and having a free end, said free end of said first foot spaced from said first leg and cooperating therewith to define a first trough, and said free end of said second foot spaced from said second leg and cooperating therewith to define a second trough.

2. The apparatus in accordance with claim 1, wherein a proximal tip extends in a proximal direction from said joined first ends of said first and second legs.

3. The apparatus in accordance with claim 1, wherein a first distal tip extends in a distal direction from a connection of said first foot and first leg and a second distal tip extends in a distal direction from a connection of said second foot and second leg.

4. The apparatus in accordance with claim 1, wherein said first and second troughs are generally "V"-shaped.

5. The apparatus in accordance with claim 1, wherein said first leg and second leg have a generally circular cross-section.

6. A method of placing an ornament on ornament stringing material with an ornamenting apparatus having a body having a proximal end and a distal end, the apparatus comprising a first leg and a second leg connected at said proximal end and including a first stop at a end of said first leg and a second stop at a distal end of said second leg, comprising the steps of:

passing at least one ornament over said proximal end of said body;

compressing said distal ends of said first and second legs towards one another;

moving said ornament along said legs towards said first and second stops;

extending ornament stringing material between said first and second legs of said body between said proximal end and said at least one ornament;

moving said at least one ornament upwardly along said first and second legs onto said ornament stringing material; and removing said ornament stringing material from between said first and second legs of said body.

7. The method in accordance with claim 6 wherein said apparatus includes a tip at said proximal end and said step of passing includes the step of extending said tip through a portion of said ornament.

8. The method in accordance with claim 6 including the step of spreading said first and second legs apart from one another between said proximal end and said ornament to permit extension of said ornament stringing material therebetween.

9. The method in accordance with claim 6 wherein said ornament stringing material comprises hair.

10. An apparatus for placing at least one ornament on ornament stringing material comprising a first link having a proximal end and a distal end, a second link having a proximal end and a distal end, said first and second links connectable at or near their proximal ends and unconnected at their distal ends, a threading tip extending in a proximal direction from said proximal ends of said first and second links, a first stop associated with said first link distal of said proximal end thereof and a second stop associated with said second link distal of said proximal end thereof, said first and second links moveable with respect to one another, said tip having a first dimension for passage thereover of at least one ornament onto said links of said apparatus and said first and second stops having a second dimension greater than said first dimension for preventing passage thereover of said at least one ornament placed on both of said links of said apparatus.

11. The apparatus in accordance with claim 10 wherein said first stop comprises a foot extending from said first link in proximal direction and cooperating therewith to form a first trough.

12. The apparatus in accordance with claim 11 wherein said second stop comprises a foot extending from said second link in a proximal direction and cooperating therewith to form a second trough.

13. A method of placing an ornament on ornament stringing material with an ornamenting apparatus having a proximal end and a distal end, the apparatus comprising a pair of legs, said legs each having a proximal end connected at said proximal end of said apparatus and each leg having a distal end, comprising the steps of:

biasing said distal ends of said legs outwardly from one another;

passing at least one ornament over said proximal end of said apparatus onto said legs;

compressing said distal ends of said legs towards one another and positioning said at least one ornament towards said distal end of said apparatus;

extending ornament stringing material between said legs of said body between said proximal end and said at least one ornament;

moving said at least one ornament along said legs towards said proximal end of said apparatus onto said ornament stringing material; and removing said ornament stringing material from between said legs of said body, removing said apparatus from said ornament stringing material and leaving said at least one ornament on said ornament stringing material.

14. The method in accordance with claim 13 including the step of forcing said legs outwardly from one another to define a space therebetween through which said ornament stringing material may be extended.

* * * * *